United States Patent [19]

Scheer

[11] 4,242,748

[45] Dec. 30, 1980

[54] ELECTRIC ALARM CLOCK

[75] Inventor: Erich Scheer, St. Georgen,, Fed. Rep. of Germany

[73] Assignee: Kundo - Kieninger & Obergfell, St. Georgen, Fed. Rep. of Germany

[21] Appl. No.: 888,962

[22] Filed: Mar. 22, 1978

[30] Foreign Application Priority Data

Mar. 25, 1977 [DE] Fed. Rep. of Germany ..... 2713221

[51] Int. Cl.[3] ..... G04B 23/00

[52] U.S. Cl. ..... 368/244; 368/250

[58] Field of Search ..... 58/18, 21.13, 21.155, 58/16 R, 16.5, 57.5, 21.15, 152 B; 325/396; 340/309.1; 200/35 R, 35 B, 38 FB, 38 DA

[56] References Cited

U.S. PATENT DOCUMENTS

| | | | |
|---|---|---|---|
| 3,946,549 | 3/1976 | Cake | 58/57.5 X |
| 3,949,240 | 4/1976 | Saito et al. | 58/152 B X |
| 4,081,754 | 3/1978 | Jackson | 325/396 |
| 4,084,104 | 4/1978 | Scheer et al. | 58/21.15 X |

*Primary Examiner*—Ulysses Weldon

*Attorney, Agent, or Firm*—Karl F. Ross

[57] ABSTRACT

An alarm clock has a clockwork which drives a 12-hour display and a waking contact which is settable over a 12-hour range. The contact works into a mono-flop or flip-flop to generate a signal in each successive 12-hour cycle at the time set by the contact and this signal is applied to a flip-flop which can energize a signal generator via circuitry ensuring the application of only one signal from the timing flip-flop during each 24-hour period.

8 Claims, 5 Drawing Figures

ELECTRIC ALARM CLOCK

SPECIFICATION FIELD OF THE INVENTION

The invention relates to an electric alarm clock, preferably of the electronic quartz-controlled type for automatically delivering a wakening signal preset to go off once in 24 hours, by means of a control circuit provided with semiconductor elements, thereby actuating at least one multivibrator switch through a signal contact set off by the clockwork, the multivibrator controlling the current fed to the alarm-signal generator, the emission of the alarm signal being terminatable either manually by a specially provided button or by the signal contact, thus automatically reestablishing the readiness for the next alarm signal sequence.

BACKGROUND OF THE INVENTION

There are known electric alarm clocks, with analog or digital time display, having a tripping device with a setting range of 24 hours. The time-display range extends therein over two times 0 . . . 12 hours, i.e., the display range is traversed twice during the 24-hour setting range of the wakening-signal tripping device. This means that by setting the time for the alarm signal, special attention has to be given to establishing the correct 12-hour interval in which the tripping device is to be actuated. This is usually done by rotating the mechanism of the hands to check in which 12-hour cycle the wakening-signal actuation will occur. Since at least in the case of battery-energized clocks, this setting procedure has to be performed only once during the lifetime of the battery, it is considered acceptable. Nevertheless, it can lead to erroneous settings or at least to a confusion of the user.

It also is significant that a tripping device with an overall setting range of 24 hours usually has a very low actuation speed, which results in a relatively imprecise repetition of the alarm signal and also provides a temporally unreliable contact.

There are also known alarm clocks with a time-display range of 12 hours and a 12-hour setting range of the wakening-signal tripping device. Here a stop switch for the alarm signal is provided, which remanently stops or interrupts the signal. In this way the actuation of the tripping device in one of the 12-hour cycles namely in the undesired cycle is precluded. An automatic reactivation of the wakening-signal tripping device is not possible; before each signal emission the alarm signal circuit has to be prepared by resetting the stop switch.

There are also known electric alarm clocks in which at least one contact is actuatable through the wakening-signal tripping device, the contact resetting a Flip Flop multivibrator circuit, thereby resetting the alarm signal generator. Through a manually actuated button, or through a switch, or through a contact actuatable by the tripping device, the flip-flop circuit is again reset and the signal emission interrupted. Simultaneously the signal readiness for the next signal emission is reestablished. In this case it is necessary, however, to provide a tripping device with a setting range of 24 hours, in ordr to benefit from the advantages of an automatic stand-by circuit.

OBJECT OF THE INVENTION

The object of the present invention is to provide an electric alarm clock with an easily settable, precise and rapidly actuatable alarm signal tripping device and which reestablishes automatically the readiness for a new emission of the signal.

SUMMARY OF THE INVENTION

The present invention attains this objective in that a time display range as well as a setting range of the wakening time are each provided with a 12-hours cycle; in that the alarm signal contactor is actuatable only once in each 12 hours; and in that the control switch is provided with a timing cycle switch actuable by the control switch, the latter being capable of eliminating one of the two 12-hour cycles of the day. A preferred further feature of the invention consists in providing the control switch with an additional, manually actuatable circuit arrangement, through which an optic or acoustic signal device can be turned on temporarily to indicate the 12-hour cycle elected for signal emission.

BRIEF DESCRIPTION OF THE DRAWING

In the following specification the invention is described in detail and schematically illustrated in the appended drawing.

In the Drawing

SPECIFIC DESCRIPTION

Figures 1, 2, 2A, 2B:
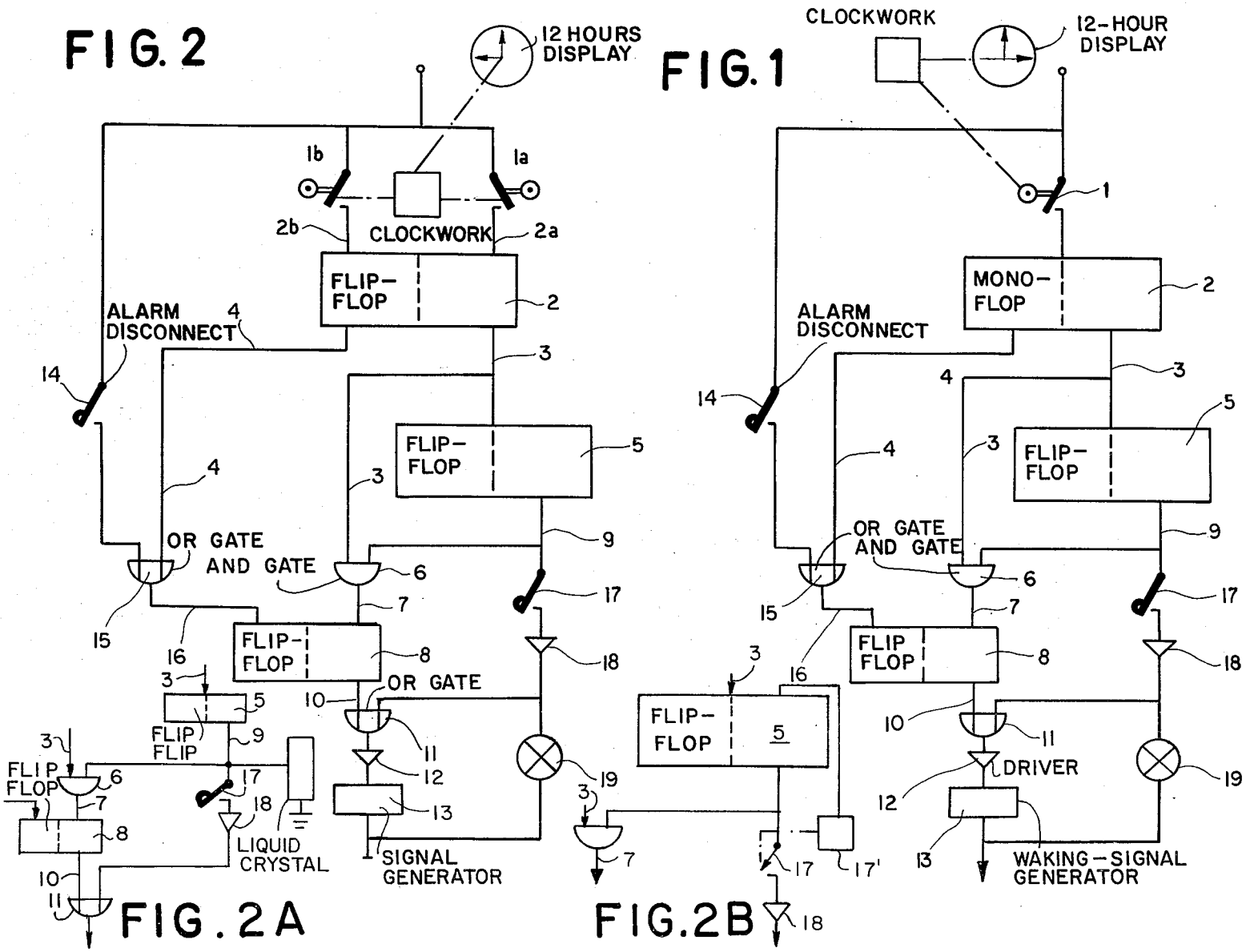
FIG. 1 is a first circuit arrangement of the electric alarm clock, according to the invention.
FIG. 2 is a second circuit arrangement of the electric alarm clock according to the invention.
FIG. 2A is a diagram of a modification of FIG. 2 showing the use of a liquid crystal to indicate the state of the circuit.
FIG. 2B is a diagram of a portion of the circuit of FIG. 2 modified with respect to the resetting of a multivibrator thereof.

In FIG. 1, the alarm-signal contact of the alarm-signal tripping device is shown at 1. This alarm signal contact 1 is closed by means of the clockwork once in every 12-hour cycle, at a time established by the presetting of the tripping device of the electric alarm clock according to this invention, and is then reopened after a while. The alarm signal contact 1 controls associated monostable (mono-flop) circuit 2, with a strongly delayed switching. This means that after the closing of the alarm signal contact 1, the output 3 of mono-flop 2 is being switched on only after several tenths of a second, while the output 4 of this multivibrator stage is reduced from its L state to 0. The output 3 of the mono-flop 2 is applied both to the input of the bistable multivibrator (flip-flop) circuit 5 and to the input of an AND-circuit 6. The output 7 thereof is applied to the set-input port of a further bistable multivibrator (flip-flop) stage 8. The flip-flop circuit 5 responds only to the descending flanks of the output 3 of the mono-flop 2. Assuming that the output 9 of the flip-flop 5 bears the signal level L, and since the output 3 of the mono-flop 2 also bears the signal L, the AND-condition for the AND-circuit 6 is established, so that the output 7 of the AND-circuit 6 will also show the signal L.

The flip-flop circuit 8 is reset thereby, i.e. a signal L appears at the output port 10 energizing the wakening-signal generator 13 through the OR-circuit 11 and the associated driving circuit 12. The wakening-signal is produced by the signal emitter 13 is maintained until resetting of the flip-flop circuit 8 either by actuating the alarm signal disconnecting or switch 14 which applies the output 16 of the OR-circuit 15 to the reset input of flip-flop 8, i.e. at the output 10 the signal L is reduced to 0, or by opening of the alarm signal contact 1 which applies the reset mono-flop circuit 2, output 4 through the OR-circuit 15 to this resetting input.

The monoflop circuit 2 is, as already mentioned, considerably delayed, i.e. by several tenths of a second, thus ensuring that brief hesitations of the alarm-signal contact 1 do not have an erroneous influence on the associated alarm-signal control switch.

Simultaneously, with the opening of the alarm signal contact 1, the output 3 of the mono-flop circuit 2 returns from 0 to L. The descending signal flank associated therewith resets the flip-flop circuit 5, so that the signal L at the output 9 is reduced to 0. Subsequently, when during the next 12-hour cycle the alarm-signal contact 1 is closed again and the output 3 is raised from signal level 0 to signal level L, the AND-circuit 6 cannot be activated; since at the outlet 9 of the flip-flop circuit 5 there appears the signal 0, the AND-requirements of the AND-gate 6 cannot be fulfilled.

By opening the alarm signal contact 1 in the second 12-hour cycle, the flip-flop circuit 5 is again influenced through the descending flank of the output 3 of the mono-flop circuit 2, the circuit 5 being reversed and the signal L reappearing at the output 9. That means that for the next, the third 12-hour cycle, the AND-requirement (condition) of the AND-circuit will again be fulfilled and the preset alarm-signal process can be effective.

By means of the flip-flop circuit 5, which acts like a timing circuit, at each opening of the alarm signal contact 1 and with each 12-hour cycle through the output 9, the AND requirement (condition) of the AND-circuit 6 for the next actuation of the alarm signal contact 1 is either approved, i.e. enabled, or negated (precluded).

According to a further feature of the circuit arrangement shown in FIG. 1, an additional device is provided the latter comprising a manually actuatable switch 17, a driving circuit 18, a lamp or light-emitting diode 19, the OR-circuit gate 11, the driving circuit 12 and the signal generator 13. By actuation of switch 17, it is possible to obtain information about the state of the circuit and the readiness of the alarm signal control circuit concerning the 12-hour cycle indicated on the dial, as well as about the next possible timing of signal emission. A lighting of the lamp or light-emitting diode 19, or an acoustic signal from the emitter 13 upon actuating of the switch 17, would indicate that the output 9 of the flip-flop circuit 5 is at the signal level L, and that during the next actuation of the alarm signal contact 1 in the just-checked 12-hour cycle an emission of the alarm signal is to be expected.

If for instance the alarm clock according to the invention is to be set at 10 a.m. for generating an alarm signal the next morning at 7 o'clock, after correspondingly setting the tripping device, and a actuating the switch 17, the lamp or light-emitting diode 19, and the signal emitter 13 would not emit any signals, since the next instance when the time indicated for the signal is to be reached would be 19.00 hours (7 p.m.), and in this case there should not be any signal emission, in order to spare battery current and to avoid unnecessary acoustic disturbances. If the setting takes place in the evening at 21.00 (9 p.m.) for instance, then the control signal has to light up, or sound, if the requisite signal emission is to take place at the predetermined time, namely at 7.00 hours in the morning.

If it becomes apparent that the control device does not work, the phase relationship between the alarm signal control-circuit and the mechanism of the hands can easily be corrected, by advancing the latter to the next 12-hour cycle, particularly since, as a rule, the previously described checking and setting procedures are to be performed only when changing the battery and modifications in the phase are not to be expected during the lifetime of the new battery.

An additional development of the circuit arrangement in the electric alarm clock according to the invention is conceivable, whereby a further contact actuatable by the switch 17, is closed in a second actuating stage of switch 17 and through which, more specifically through the crop of the flank of the pulse during its opening, the flip-flop circuit 5 can be reversed in state (see FIG. 2B in which the further contact is represented at 17').

In this case, it is first necessary to check the timing state of the flip-flop circuit 5 in the first actuating stage of switch 17, in order to correct it, if necessary, by actuating the switch 17 in its second actuating stage.

In the circuit arrangement according to FIG. 2, the alarm signal contact 1 of FIG. 1 is replaced by two alarm-signal contacts 1*a* and 1*b*, both independently actuatable and separated from the tripping device.

Alarm signal contact 1*a* is actuated for the emission of the alarm signal and alarm signal contact 1*b* is actuated for the interruption of the signal to be delivered. The alarm signal contact 1*a* is connected to the input 2*a* and the alarm signal contact 1*b* is connected to the input 2*b* of a flip-flop circuit 2', which replaces the mono-flop circuit 2 of the circuit arrangement in FIG. 1.

Controlling the circuit arrangement according to FIG. 2 with a connect contact (1*a*) and a disconnect contact (1*b*) requires a considerably more complicated tripping device, but offers instead the possibility to bridge even longer contact interruptions in case of unsafe contact actuating.

While in the circuit arrangement of FIG. 1, upon closing of the alarm-signal contact 1, the mono-flop circuit 2 delays the setting of the signal L at output 3, and after the opening of the alarm signal contact 1 this signal is reset with a delay at output 4, in the circuit arrangement of FIG. 2, by closing the alarm signal contact 1*a* the output 3 of the flip-flop stage 2' is set for signal L. This circuit condition cannot be influenced by the opening of contact 1*a*. The resetting of the flip-flop circuit 2 takes place only when the alarm signal contact 1*b* is closed, so that the signal L appears at the output 4, while the output 3 returns to signal 0. Once the actuation of the signal level contact 1*a*, as well as the closing of the contacts following actuation of the contact 1*b* have been performed, interruptions do not have any influence on the flip-flop circuit 2.

Figure 3:
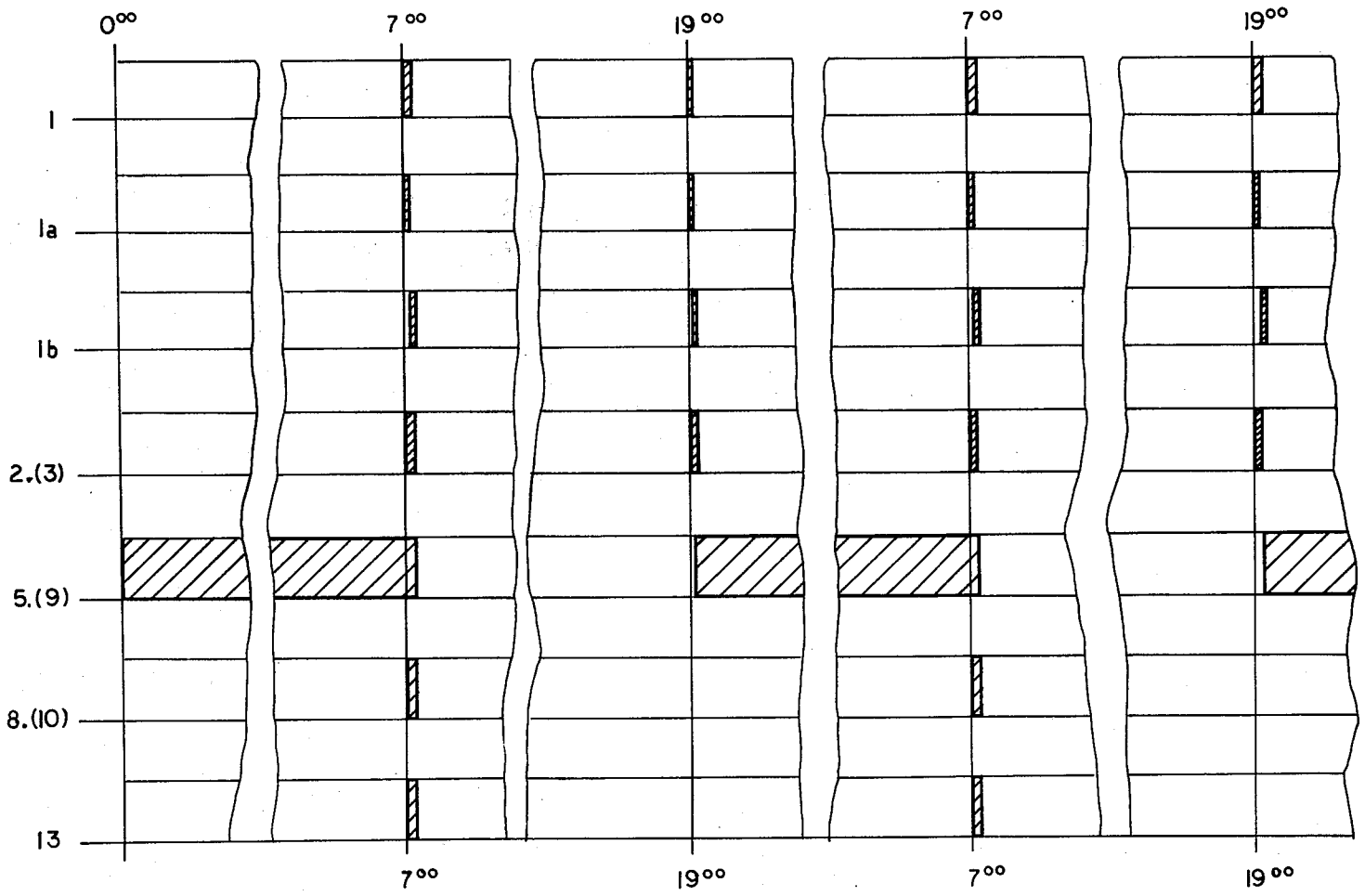
FIG. 3 is a pulse diagram or timing graph of the circuit arrangements according to FIGS. 1 and 2.

FIG. 3 diagrams the functions of the various elements over a number of 12-hour cycles, the times being represented along the upper and lower abscissae. At 1, 1*a* and 1*b*, the pulses generated by the brief closures of the contacts of the corresponding reference numerals have been shown while the output of the monoflop at 3 or the flip-flop (FIG. 2) at the same terminal has been indicated as well. This signal switches over the states indicated at 9 of the multivibrator 5 in the next lower diagram and the effect upon the flip-flop 8 at its output 10 can also be seen. The signal generator 13 is thus operated at 7 am during each 24-hour period (bottom row in FIG. 3).

Instead of the proposed glow lamp or light-emitting diode 19, the timing state can be optically indicated by using the luminous element for lighting the dial, providing a suitable circuit arrangement for this indicating purpose.

Another suitable development of the optical indication system of the timing state of timing circuit 5, according to this invention, for an alarm clock according to the invention comprises a built-in liquid-crystal cell, indicating the timing state of the circuit arrangement (see FIG. 2A). Considering the very low current consumption of such an indicating device, it is not necessary to provide for the liquid-crystal cell a manual connecting and disconnecting switch; the indicating element can be permanently connected, stating at any time the timing position of the circuit arrangement of the electric alarm clock.

Thus a special device for connecting and disconnecting the liquid-crystal cell can be eliminated, creating the possibility of a very simple circuit construction of the electrical alarm clock according to the invention.

The indicating element is placed in this case directly on the dial of the electric alarm clock, so that it can be illuminated concomittantly with the analog (or digital) time display by a built-in manually connectable illuminating device, which can also be read at night.

The limited lifetime of the liquid-crystal cell need not be of concern, since it is connected only half the time, due to the alternating 12-hour cycle, which ensures a sufficient life for the cell.

Due to this arrangement according to the invention the construction of the tripping device is simplified and its precision enhanced. It is possible to obtain a simple way of setting the alarm clock, which as a rule, has to be performed only once, namely when mounting a new energy source. Once the signal is set, this original setting remains until resetting, the electric alarm clock according to the invention being able to emit the signal only once, in spite of the 12-hour display of the clock and in spite of a 12-hour range for the setting of the alarm signal, without triggering the disconnecting button of the alarm signal.

I claim:

1. A waking-signal control system for an electric alarm clock having a clockwork driving a 12-hour time display and having an alarm-signal contact settable over a 12-hour range, said system comprising in combination:

a waking-signal generator energizable to produce a waking signal;

a first circuit connected to and responsive to said contact for producing a signal at a time determined by the setting of said contact in each of two 12-hour cycles within a 24-hour period representing a day;

a timing multivibrator connected to said first circuit and responsive to the signal produced thereby for triggering between alternate states to output an operating signal in one of said states;

a second circuit connected to said multivibrator and responsive to said operating signal and connected to said signal generator for energizing same in response to only one of the signals triggered in said first circuit by said contact in each of the 12-hour cycles of the day; and a manually actuatable switching device connected to the output of said multivibrator and a signal device connected in circuit with said switching device for indicating the 12-hour cycle over which said signal generator is to respond to said contact.

2. The waking signal control system for an electric alarm clock defined in claim 1, further comprising an alarm disconnect switch connected to said second circuit and manually operable to terminate the operation of said signal generator.

3. The waking signal control system defined in claim 1 wherein said switching device is constructed and arranged to reverse the state of said multivibrator in a selected position of said switch device.

4. A waking-signal control system for an electric alarm clock having a clockwork driving a 12-hour time display and having an alarm-signal contact settable over a 12-hour range, said system comprising in combination:

a waking-signal generator energizable to produce a waking signal;

a first circuit connected to and responsive to said contact for producing a signal at a time determined by the setting of said contact in each of two 12-hour cycles within a 24-hour period representing a day;

a timing multivibrator connected to said first circuit and responsive to the signal produced thereby for triggering between alternate states to output an operating signal in one of said states; and a second circuit connected to said multivibrator and responsive to said operating signal and connected to said signal generator for energizing same in response to only one of the signal triggered in said first circuit by said contact in each of the 12-hour cycles of the day, said second circuit including an AND-gate having one input connected to the output of said multivibrator and another input connected to an output of said first circuit;

a flip-flop having one input connected to the output of said AND-gate, an alarm-disconnect switch connected to one input of an OR-gate;

said first circuit having another output connected to an input of said OR-gate, the output of said OR-gate being connected to a second input of said flip-flop, the output of said flip-flop controlling said signal generator.

5. The waking signal control system defined in claim 4 wherein the output of said flip-flop is applied to one input of a further OR-gate, another input of said further OR-gate being connected via a switch device to the output of said multivibrator, said switch device being manually actuatable to signal to which of the 12-hour cycles the signal generator will respond, the output of said further OR-gate being connected to said signal generator.

6. A waking-signal control system for an electric alarm clock having a clockwork driving a 12-hour time display and having an alarm-signal contact settable over a 12-hour range, said system comprising in combination:

a waking-signal generator energizable to produce a waking signal;

a first product connected to and responsive to said contact for producing a signal at a time determined by the setting of said contact in each of two 12-hour cycles within a 24-hour period representing a day;

a timing multivibrator connected to said first circuit and responsive to the signal produced thereby for triggering between alternate states to output an operating signal in one of said states; and a second circuit connected to said multivibrator and responsive to said operating signal and connected to said signal generator for energizing same in response to only one of the signals triggered in said first circuit by said contact in each of the 12-hour cycles lf the day, a liquid crystal cell being provided and is energizable by said multivibrator for only one of the 12-hour cycles of each 24-hour period.

7. A waking-signal control system for an electric clock having a clockwork driving a 12-hour time display and having an alarm-signal contact settable over a 12-hour range, said system comprising in combination:

a waking-signal generator energizable to produce a waking signal;

a first circuit connected to and responsive to said contact for producing a signal at a time determined by the setting of said contact in each of two 12-hour cycles within a 24-hour period representing a day, said clockwork driving a further contact in addition to said alarm-signal contact, said first circuit comprising a flip-flop set by said alarm-signal contact and reset by said further contact;

a timing multivibrator connected to said first circuit and responsive to the signal produced by said flip-flop for triggering between alternate states to output an operating signal in one of said states; and a second circuit connected to said multivibrator and responsive to said operating signal and connected to said signal generator for energizing same in response to only one of the signals triggered in said first circuit by said contact in each of the 12-hour cycles of the day.

8. A waking-signal control system for an electric alarm clock having a clockwork driving a 12-hour time display and having an alarm-signal contact settable over a 12-hour range, said system comprising in combination:

a waking-signal generator energizable to produce a waking signal;

a first circuit connected to and responsive to said contact for producing a signal at a time determined by the setting of said contact in each of two 12-hour cycles within a 24-hour period representing a day, said first circuit including a monostable multivibrator responsive to said contact;

a timing multivibrator connected to said first circuit and responsive to the signal produced by said monostable multivibrator for triggering between alternate states to output an operating signal in one of said states; and a second circuit connected to said timing multivibrator and responsive to said operating signal and connected to said signal generator for energizing same in response to only one of the signals triggered in said first circuit by said contact in each of the 12-hour cycles of the day.

* * * * *